US010299064B2

(12) United States Patent
Di Censo et al.

(10) Patent No.: US 10,299,064 B2
(45) Date of Patent: May 21, 2019

(54) SURROUND SOUND TECHNIQUES FOR HIGHLY-DIRECTIONAL SPEAKERS

(71) Applicant: Harman International Industries, Incorporated, Stamford, CT (US)

(72) Inventors: Davide Di Censo, Oakland, CA (US); Stefan Marti, Oakland, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/570,718

(22) PCT Filed: Jun. 10, 2015

(86) PCT No.: PCT/US2015/035030
§ 371 (c)(1),
(2) Date: Oct. 30, 2017

(87) PCT Pub. No.: WO2016/200377
PCT Pub. Date: Dec. 15, 2016

(65) Prior Publication Data

US 2018/0295461 A1 Oct. 11, 2018

(51) Int. Cl.
*H04S 7/00* (2006.01)
*H04S 3/00* (2006.01)
(Continued)

(52) U.S. Cl.
CPC ..... *H04S 7/303* (2013.01); *H04R 1/403* (2013.01); *H04R 5/02* (2013.01); *H04R 5/04* (2013.01);
(Continued)

(58) Field of Classification Search
CPC ..... H04S 7/303; H04S 3/008; H04S 2400/01; H04S 2400/11; H04R 5/02; H04R 5/04; H04R 1/403
(Continued)

(56) References Cited

U.S. PATENT DOCUMENTS

2001/0055397 A1* 12/2001 Norris ..... G10H 1/0091 381/79
2013/0121515 A1* 5/2013 Hooley ..... H04R 1/403 381/307
(Continued)

FOREIGN PATENT DOCUMENTS

EP 1662842 A1 5/2006
WO 2011114252 A1 9/2011
WO 2014036085 A1 3/2014

OTHER PUBLICATIONS

International Search Report Application No. PCT/2015/035030, dated Jan. 18, 2016, 11 pages.

*Primary Examiner* — William A Jerez Lora
(74) *Attorney, Agent, or Firm* — Artegis Law Group, LLP

(57) ABSTRACT

One embodiment of the present invention sets forth a technique for generating an audio event within a listening environment. The technique includes determining a speaker orientation based on a location of the audio event within a sound space being generated within the listening environment and causing a speaker to be positioned according to the speaker orientation. The technique further includes, while the speaker is positioned according to the speaker orientation, causing the audio event to be transmitted by the speaker.

20 Claims, 6 Drawing Sheets

(51) Int. Cl.

| | |
|---|---|
| ***H04R 1/40*** | (2006.01) |
| ***H04R 5/02*** | (2006.01) |
| ***H04R 5/04*** | (2006.01) |
| *H04R 1/32* | (2006.01) |

(52) U.S. Cl.
CPC ..... *H04S 3/008* (2013.01); *H04S 7/302* (2013.01); *H04R 1/323* (2013.01); *H04S 2400/01* (2013.01); *H04S 2400/11* (2013.01)

(58) Field of Classification Search
USPC ..... 381/56, 58, 303, 310
See application file for complete search history.

(56) References Cited

U.S. PATENT DOCUMENTS

2014/0254811 A1* 9/2014 Takeda ..... H04S 7/303 381/58
2016/0174011 A1* 6/2016 Rider ..... H04S 7/303 381/303

* cited by examiner

SURROUND SOUND TECHNIQUES FOR HIGHLY-DIRECTIONAL SPEAKERS

CROSS-REFERENCE TO RELATED APPLICATIONS

The present application is a national stage application of the international application titled, "SURROUND SOUND TECHNIQUES FOR HIGHLY-DIRECTIONAL SPEAKERS," filed on Jun. 10, 2015 and having application number PCT/US2015/035030. The subject matter of this related application is hereby incorporated herein by reference.

BACKGROUND

Field of the Embodiments of the Invention

Embodiments of the present invention generally relate to audio systems and, more specifically, to surround sound techniques for highly-directional speakers.

Description of the Related Art

Entertainment systems, such as audio/video systems implemented in movie theaters, home theaters, music venues, and the like, continue to provide increasingly immersive experiences that include high-resolution video and multi-channel audio soundtracks. For example, commercial movie theater systems commonly enable multiple, distinct audio channels to be decoded and reproduced, enabling content producers to create a detailed, surround sound experience for movie goers. Additionally, consumer level home theater systems have recently implemented multi-channel audio codecs that enable a theater-like surround experience to be enjoyed in a home environment.

Unfortunately, advanced multi-channel home theater systems are impractical for many consumers, since such systems typically require a consumer to purchase six or more speakers (e.g., five speakers and a subwoofer for 5.1-channel systems) in order to produce an acceptable surround sound experience. Moreover, many consumers do not have sufficient space in their homes for such systems, do not have the necessary wiring infrastructure (e.g., in-wall speaker and/or power cables) in their homes to support multiple speakers, and/or may be reluctant to place large and/or obtrusive speakers within living areas.

In addition, other limitations may arise when attempting to generate an acceptable audio experience in a commercial setting, such as in a movie theater. For example, due to the size of many movie theaters, it is difficult to produce a consistent audio experience at each of the seating positions. In particular, theater goers that are positioned near the walls of the theater may have significantly different audio experiences than those positioned near the center of the theater.

As the foregoing illustrates, techniques that enable audio events to be more effectively generated would be useful.

SUMMARY

One embodiment of the present invention sets forth a non-transitory computer-readable storage medium including instructions that, when executed by a processor, cause the processor to generate an audio event within a listening environment. The instructions cause the processor to perform the steps of determining a speaker orientation based on a location of the audio event within a sound space being generated within the listening environment, and causing a speaker to be positioned according to the speaker orientation. The instructions further cause the processor to perform the step of, while the speaker is positioned according to the speaker orientation, causing the audio event to be transmitted by the speaker.

Further embodiments provide, among other things, a method and system configured to implement various aspects of the system set forth above.

At least one advantage of the disclosed techniques is that a two-dimensional or three-dimensional surround sound experience may be generated using fewer speakers and without requiring speakers to be obtrusively positioned at multiple locations within a listening environment. Additionally, by tracking the position(s) of users and/or objects within a listening environment, a different sound experience may be provided to each user without requiring the user to wear a head-mounted device and without significantly affecting other users within or proximate to the listening environment. Accordingly, audio events may be more effectively generated within various types of listening environments.

BRIEF DESCRIPTION OF THE SEVERAL VIEWS OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the embodiments of the present invention. However, it will be apparent to one of skill in the art that the embodiments of the present invention may be practiced without one or more of these specific details.

Figure 1:
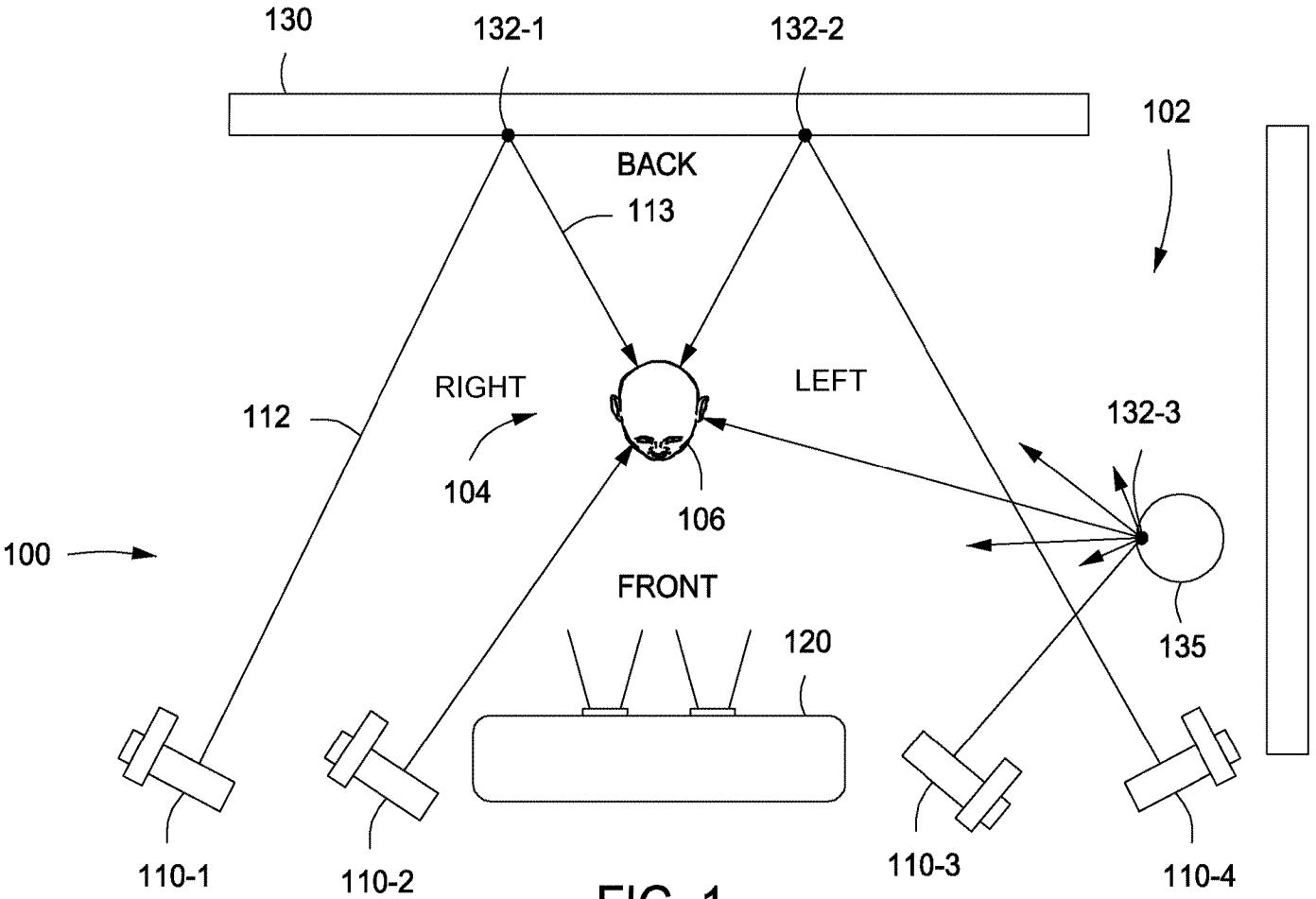
FIG. 1 illustrates an audio system for generating audio events via highly-directional speakers within a listening environment, according to various embodiments.

FIG. 1 illustrates an audio system 100 for generating audio events via highly-directional speakers 110, according to various embodiments. As shown, the audio system 100 includes one or more highly-directional speakers 110 and a sensor 120 positioned within a listening environment 102. In some embodiments, the orientation and/or location of the highly-directional speakers 110 may be dynamically modified, while, in other embodiments, the highly-directional speakers 110 may be stationary. The listening environment 102 includes walls 130, furniture items 135 (e.g., bookcases, cabinets, tables, dressers, lamps, appliances, etc.), and/or other objects towards which sound waves 112 may be transmitted by the highly-directional speakers 110.

In operation, the sensor 120 tracks a listening position 106 (e.g., the position of a user) included in the listening environment 102. The highly-directional speakers 110 then transmit sound waves 112 towards the listening position 106 and/or towards target locations on one or more surfaces (e.g., location 132-1, location 132-2, and location 132-3) included in the listening environment 102. More specifically, sound waves 112 may be transmitted directly towards the listening position 106 and/or sound waves 112 may be reflected off of various types of surfaces included in the listening environment 102 in order to generate audio events at specific locations within a sound space 104 generated by the audio system 100. For example, and without limitation, assuming that a user located at the listening position 106 is facing towards the sensor 120, a highly-directional speaker 110 (e.g., highly-directional speaker 110-1) may generate an audio event behind and to the right of the user (e.g., at a right, rear location within the sound space 104) by transmitting sound waves towards location 132-1. Similarly, a highly-directional speaker 110 (e.g., highly-directional speaker 110-4) may generate an audio event behind and to the left of the user (e.g., at a left, rear location within the sound space 104) by transmitting sound waves towards location 132-2. Further, a highly-directional speaker 110 (e.g., highly-directional speaker 110-3) may be pointed towards a furniture item 135 (e.g., a lamp shade) in order to generate an audio event to the left and slightly in front of the user (e.g., at a left, front location within the sound space 104). Further, a highly-directional speaker 110 (e.g., highly-directional speaker 110-2) may be pointed at the user (e.g., at an ear of the user) in order to generate an audio event at a location within the sound space 104 that corresponds to the location of the highly-directional speaker 110 itself (e.g., at a right, front location within the sound space 104 shown in FIG. 1).

In addition to generating audible audio events for a user, one or more highly-directional speakers 110 may be used to generate noise cancellation signals. For example, and without limitation, a highly-directional speaker 110 could generate noise cancellation signals, such as an inverse sound wave, that reduces the volume of specific audio events with respect to one or more users. Generating noise cancellation signals via a highly-directional speaker 110 may enable the audio system 100 to reduce the perceived volume of audio events with respect to specific users. For example, and without limitation, a highly-directional speaker 110 could transmit a noise cancellation signal towards a user (e.g., by reflecting the noise cancellation signal off of an object in the listening environment 102) that is positioned close to a location 132 at which a sound event is generated, such that the volume of the audio event is reduced with respect to that user. Consequently, the user that is positioned close to the location 132 would experience the audio event at a similar volume as other users that are positioned further away from the location 132. Accordingly, the audio system 100 could generate a customized and relatively uniform listening experience for each of the users, regardless of the distance of each user from one or more locations 132 within the listening environment 102 at which audio events are generated.

In various embodiments, one or more listening positions 106 (e.g., the locations of one or more users) are tracked by the sensor 120 and used to determine the orientation in which each highly-directional speaker 110 should be positioned in order to cause audio events to be generated at the appropriate location(s) 132 within the sound space 104. For example, and without limitation, the sensor 120 may track the location(s) of the ear(s) of one or more users and provide this information to a processing unit included in the audio system 100. The audio system 100 then uses the location of the user(s) to determine one or more speaker orientation(s) that will enable the highly-directional speakers 110 to cause audio events to be reflected towards each listening position 106 from the appropriate locations within the listening environment 102.

One or more of the highly-directional speakers 110 may be associated with a single listening position 106 (e.g., with a single user), or one or more of the highly-directional speaker(s) 110 may generate audio events for multiple listening positions 106 (e.g., for multiple users). For example, and without limitation, one or more highly-directional speakers 110 may be configured to target and follow a specific user within the listening environment 102, such as to maintain an accurate stereo panorama or surround sound field relative to the user. Such embodiments enable the audio system 100 to transmit audio events only to a specified user, producing an auditory experience that is similar to the use of headphones, but without requiring the user to wear anything on his or her head. In another non-limiting example, the highly-directional speakers 110 may be positioned within a movie theater, music venue, etc. in order to transmit audio events to the ears of each user, enabling a high-quality audio experience to be produced at every seat in the audience and minimizing the traditional speaker set-up time and complexity. Additionally, such embodiments enable a user to listen to audio events (e.g., a movie or music soundtrack) while maintaining the ability to hear other sounds within or proximate to the listening environment 102. Further, transmitting audio events via a highly-directional speaker 110 only to a specified user allows the audio system 100 to provide listening privacy to the specified user (e.g., when the audio events include private contents) and reduces the degree to which others within or proximate to the listening environment 102 (e.g. people sleeping or studying proximate to the user or in a nearby room) are disturbed by the audio events. In the same or other embodiments, the listening position 106 is static (e.g., positioned proximate to the center of the room, such as proximate to a sofa or other primary seating position) during operation of the audio system 100 and is not tracked or updated based on movement of user(s) within the listening environment 102.

In various embodiments, instead of (or in addition to) tracking the location of a user, the sensor 120 may track objects and/or surfaces (e.g., walls 130, furniture items 135, etc.) included within the listening environment 102. For example, and without limitation, the sensor 120 may perform scene analysis (or any similar type of analysis) to determine and/or dynamically track the distance and location of various objects (e.g., walls 130, ceilings, furniture items 135, etc.) relative to the highly-directional speakers 110 and/or the listening position 106. In addition, the sensor 120 may determine and/or dynamically track the orientation(s) of the surface(s) of objects, such as, without limitation, the orientation of a surface of a wall 130, a ceiling, or a furniture item 135 relative to a location of a highly-directional speaker 110 and/or the listening position 106. The distance, location, orientation, surface characteristics, etc. of the objects/surfaces are then used to determine speaker orientation(s) that will enable the highly-directional speakers 110 to generate audio events (e.g., via reflected sound waves 113) at specific locations within the sound space 104. For example, and without limitation, the audio system 100 may take into account the surface characteristics (e.g., texture, uniformity, density, etc.) of the listening environment 102 when determining which surfaces should be used to generate audio events. In some embodiments, the audio system 100 may perform a calibration routine to test (e.g., via one or more microphones) surfaces of the listening environment 102 to determine how the surfaces reflect audio events. Accordingly, the sensor 120 enables the audio system 100 to, without limitation, (a) determine where the user is located in the listening environment 102, (b) determine the distances, locations, orientations, and/or surface characteristics of objects proximate to the user, and (c) track head movements of the user in order to generate a consistent and realistic audio experience, even when the user tilts or turns his or her head.

The sensor 120 may implement any sensing technique that is capable of tracking objects and/or users (e.g., the position of a head or ear of a user) within a listening environment 102. In some embodiments, the sensor 120 includes a visual sensor, such as a camera (e.g., a stereoscopic camera). In such embodiments, the sensor 120 may be further configured to perform object recognition in order to determine how or whether sound waves 112 can be effectively reflected off of a particular object located in the listening environment 102. For example, and without limitation, the sensor 120 may perform object recognition to identify walls and/or a ceiling included in the listening environment 102. Additionally, in some embodiments, the sensor 120 includes ultrasonic sensors, radar sensors, laser sensors, thermal sensors, and/or depth sensors, such as time-of-flight sensors, structured light sensors, and the like. Although only one sensor 120 is shown in FIG. 1, any number of sensors 120 may be positioned within the listening environment 102 to track the locations, orientations, and/or distances of objects, users, highly-directional speakers 110, and the like. In some embodiments, a sensor 120 is coupled to each highly-directional speaker 110, as described below in further detail in conjunction with FIG. 2.

In various embodiments, the surfaces of one or more locations 132 of the listening environment 102 towards which sound waves 112 are transmitted may produce relatively specular sound reflections. For example, and without limitation, the surface of the wall at location 132-1 and location 132-2 may include a smooth, rigid material that produces sound reflections having an angle of incidence that is substantially the same as the dominate angle of reflection, relative to a surface normal. Accordingly, audio events may be generated at location 132-1 and location 132-2 without causing significant attenuation of the reflected sound waves 113 and without causing secondary sound reflections (e.g., off of other objects within the listening environment 102) to reach the listening position 106.

In the same or other embodiments, surface(s) associated with the location(s) 132 towards which sound waves 112 are transmitted may produce diffuse sound reflections. For example, and without limitation, the surface of the lamp shade 135 at location 132-3 may include a textured material and/or rounded surface that produces multiple sound reflections having different trajectories and angles of reflection. Accordingly, audio events generated at location 132-3 may occupy a wider range of the sound space 104 when perceived by a user at listening position 106. In some embodiments, the use of diffuse surfaces to produce sound reflections enables audio events to be generated (e.g., perceived by the user) at locations within the sound space 104 that, due to the geometry of the listening environment 102, would be difficult to achieve via a dominant angle of reflection that directly targets the ears of a user. In such cases, a diffuse surface may be targeted by the highly-directional speakers 110, causing sound waves 113 reflected at non-dominant angle(s) to propagate towards the user from the desired location in the sound space 104.

Substantially specular and/or diffuse sound reflections may be generated at various locations 132 within the listening environment 102 by purposefully positioning objects, such as sound panels designed to produce a specific type of reflection (e.g., a specular reflection, sound scattering, etc.) within the listening environment 102. For example, and without limitation, specific types of audio events to be generated at specific locations within the listening environment 102 by transmitting sound waves 112 towards sound panels positioned at location(s) on the walls (e.g., sound panels positioned at location 132-1 and location 132-2), locations on the ceiling, and/or other locations within the listening environment 102 (e.g., on pedestals or suspended from a ceiling structure). In various embodiments, the sound panels may include static panels and/or dynamically adjustable panels that are repositioned via actuators. In addition, identification of the sound panels by the sensor 120 may be facilitated by including visual markers and/or electronic markers on/in the panels. Such markers may further indicate to the audio system 100 the type of sound panel (e.g., specular, scattering, etc.) and/or the type of sounds intended to be reflected by the sound panel. Positioning dedicated sound panels within the listening environment 102 and/or treating surfaces of the listening environment 102 (e.g., with highly-reflective or scattering paint) may enable audio events to be more effectively generated at desired locations within the sound space 104 generated by the audio system 100.

The audio system 100 may be positioned in a variety of listening environments 102. For example, and without limitation, the audio system 100 may be implemented in consumer audio applications, such as in a home theater, an automotive environment, and the like. In other embodiments, the audio system 100 may be implemented in various types of commercial applications, such as, without limitation, movie theaters, music venues, theme parks, retail spaces, restaurants, and the like.

Figure 2:
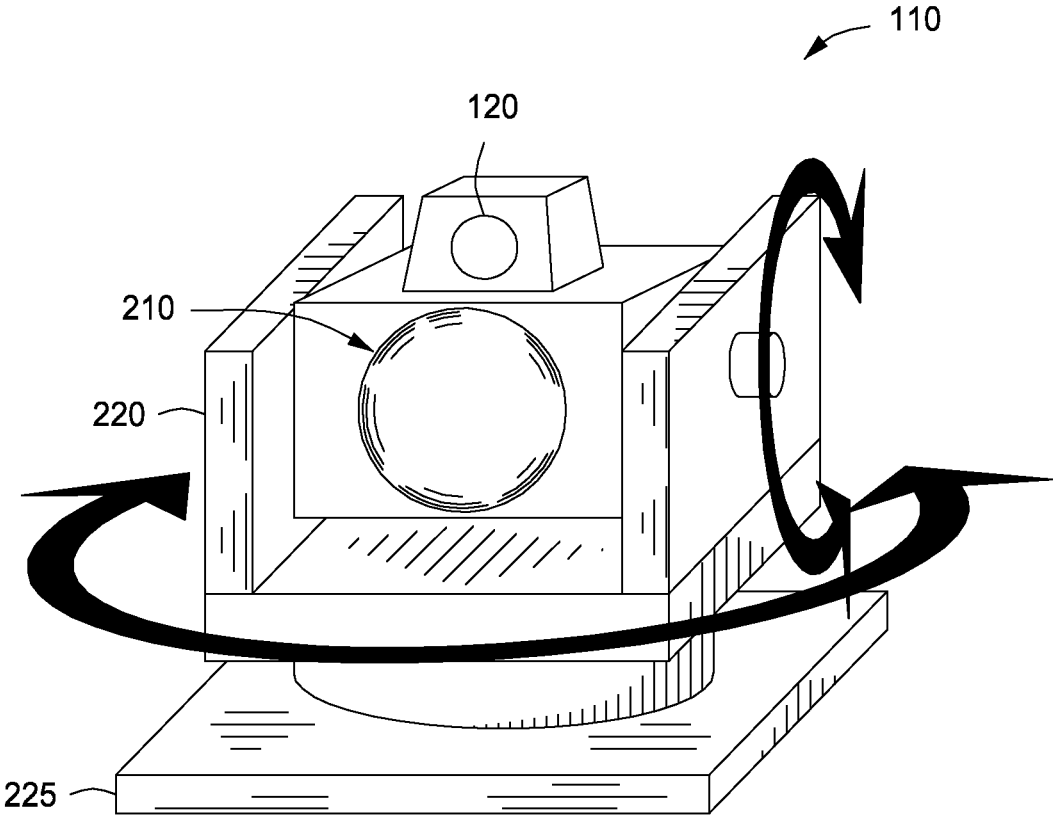
FIG. 2 illustrates a highly-directional speaker on a pan-tilt assembly that may be implemented in conjunction with the audio system of FIG. 1, according to various embodiments.

FIG. 2 illustrates a highly-directional speaker 110 on a pan-tilt assembly 220 that may be implemented in conjunction with the audio system 100 of FIG. 1, according to various embodiments. The highly-directional speaker 110 includes one or more drivers 210 coupled to the pan-tilt assembly 220. The pan-tilt assembly 220 is coupled to a base 225. The highly-directional speaker 110 may also include one or more sensors 120.

The driver 210 is configured to emit sound waves 112 having very low beam divergence, such that a narrow cone of sound may be transmitted in a specific direction (e.g., towards a specific location 132 on a surface included in the listening environment 102). For example, and without limitation, when directed towards an ear of a user, sound waves 112 generated by the driver 210 are audible to the user but may be substantially inaudible or unintelligible to other people that are proximate to the user. Although only a single driver 210 is shown in FIG. 2, any number of drivers 210 arranged in any type of array, grid, pattern, etc. may be implemented. For example, and without limitation, in order to effectively produce highly-directional sound waves 112, an array of small (e.g., one to five centimeter diameter) drivers 210 may be included in each highly-directional speaker 110. In some embodiments, an array of drivers 210 is used to create a narrow sound beam using digital sound processing (DSP) techniques, such as cross-talk cancellation methods. In addition, the array of drivers 210 may enable the sound waves 112 to be steered by separately and dynamically modifying the audio signals that are transmitted to each of the drivers 210.

In some embodiments, the highly-directional speaker 110 generates a modulated sound wave 112 that includes two ultrasound waves. One ultrasound wave serves as a reference tone (e.g., a constant 200 kHz carrier wave), while the other ultrasound wave serves as a signal, which may be modulated between about 200,200 Hz and about 220,000 Hz. Once the modulated sound wave 112 strikes an object (e.g., a user's head), the ultrasound waves slow down and mix together, generating both constructive interfere and destructive interference. The result of the interference between the ultrasound waves is a third sound wave 113 having a lower frequency, typically in the range of about 200 Hz to about 20,000 Hz. In some embodiments, an electronic circuit attached to piezoelectric transducers constantly alters the frequency of the ultrasound waves (e.g., by modulating one of the waves between about 200,200 Hz and about 220,000 Hz) in order to generate the correct, lower-frequency sound waves when the modulated sound wave 112 strikes an object. The process by which the two ultrasound waves are mixed together is commonly referred to as "parametric interaction."

The pan-tilt assembly 220 is operable to orient the driver 210 towards a location 132 in the listening environment 102 at which an audio event is to be generated relative to the listening position 106. Sound waves 112 (e.g., ultrasound carrier waves and audible sound waves associated with an audio event) are then transmitted towards the location 132, causing reflected sound waves 113 (e.g., the audible sound waves associated with the audio event) to be transmitted towards the listening position 106 and perceived by a user as originating from the location 132. Accordingly, the audio system 100 is able to generate audio events at precise locations within a three-dimensional sound space 104 (e.g., behind the user, above the user, next to the user, etc.) without requiring multiple speakers to be positioned at those locations in the listening environment 102. One such highly-directional speaker 110 that may be implemented in various embodiments is a hypersonic sound speaker (HSS), such as the Audio Spotlight speaker produced by Holosonic®. However, any other type of loudspeaker that is capable of generating sound waves 112 having very low beam divergence may be implemented with the various embodiments disclosed herein. For example, the highly-directional speakers 110 may include speakers that implement parabolic reflectors and/or other types of sound domes, or parabolic loudspeakers that implement multiple drivers 210 arranged on the surface of a parabolic dish. Additionally, the highly-directional speakers 110 may implement sound frequencies that are within the human hearing range and/or the highly-directional speakers 110 may employ modulated ultrasound waves. Various embodiments may also implement planar, parabolic, and array form factors.

The pan-tilt assembly 220 may include one or more robotically controlled actuators that are capable of panning and/or tilting the driver 210 relative to the base 225 in order to orient the driver 210 towards various locations 132 in the listening environment 102. The pan-tilt assembly 220 may be similar to assemblies used in surveillance systems, video production equipment, etc. and may include various mechanical parts (e.g., shafts, gears, ball bearings, etc.), and actuators that drive the assembly. Such actuators may include electric motors, piezoelectric motors, hydraulic and pneumatic actuators, or any other type of actuator. The actuators may be substantially silent during operation and/or an active noise cancellation technique (e.g., noise cancellation signals generated by the highly-directional speaker 110) may be used to reduce the noise generated by movement of the actuators and pan-tilt assembly 220. In some embodiments, the pan-tilt assembly 220 is capable of turning and rotating in any desired direction, both vertically and horizontally. Accordingly, the driver(s) 210 coupled to the pan-tilt assembly 220 can be pointed in any desired direction. In other embodiments, the assembly to which the driver(s) 210 are coupled is capable of only panning or tilting, such that the orientation of the driver(s) 210 can be changed in either a vertical or a horizontal direction.

In some embodiments, one or more sensors 120 are mounted on a separate pan-tilt assembly from the pan-tilt assembly 220 on which the highly-directional speaker(s) 110 are mounted. Additionally, one or more sensors 120 may be mounted at fixed positions within the listening environment 102. In such embodiments, the one or more sensors 120 may be mounted within the listening environment 102 in a manner that allows the audio system 100 to maintain a substantially complete view of the listening environment 102, enabling objects and/or users within the listening environment 102 to be more effectively tracked.

Figure 3:
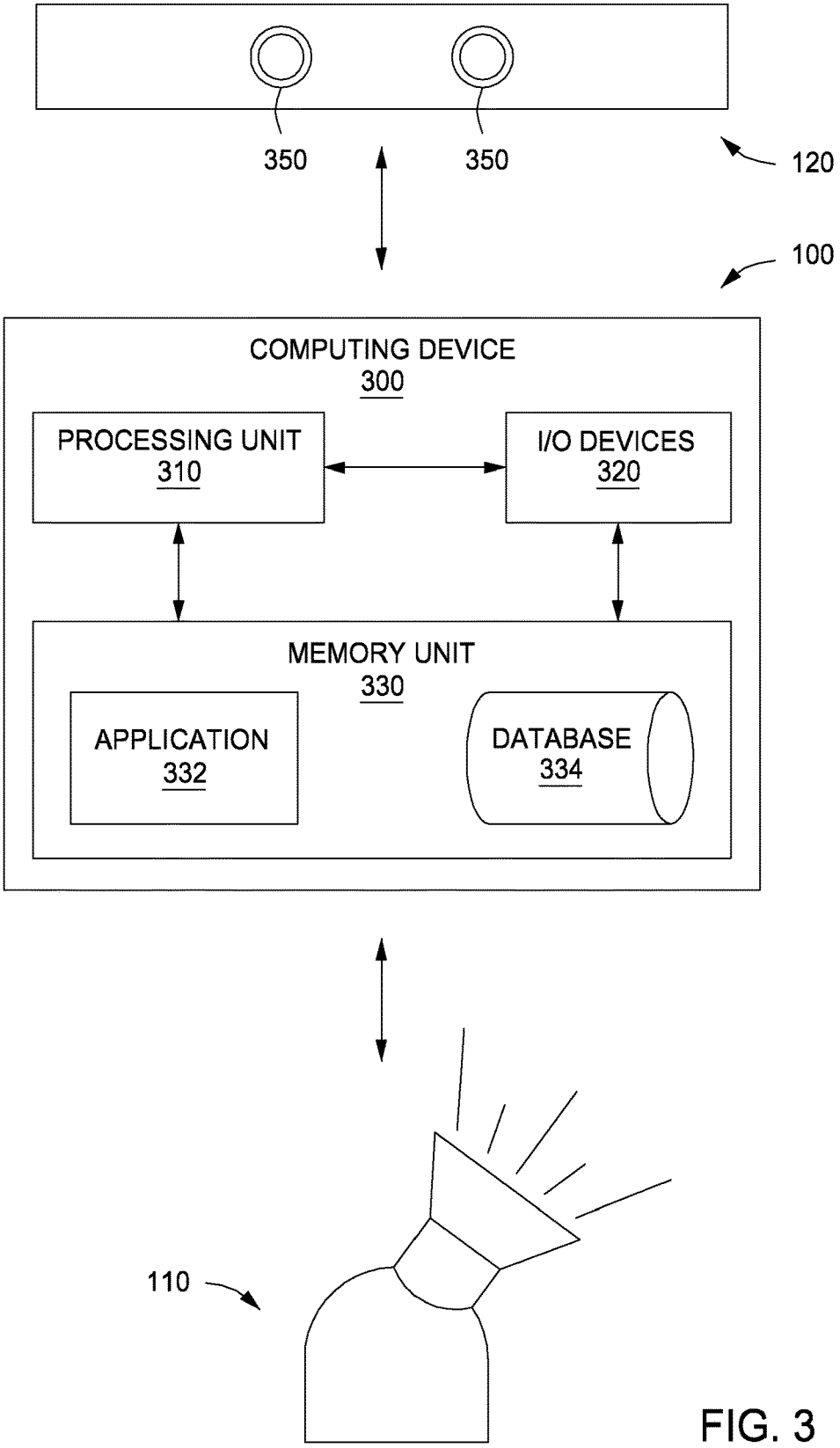
FIG. 3 is a block diagram of a computing device that may be implemented in conjunction with or coupled to the audio system of FIG. 1, according to various embodiments.

FIG. 3 is a block diagram of a computing device 300 that may be implemented in conjunction with or coupled to the audio system 100 of FIG. 1, according to various embodiments. As shown, computing device 300 includes a processing unit 310, input/output (I/O) devices 320, and a memory device 330. Memory device 330 includes an application 332 configured to interact with a database 334. The computing device 300 is coupled to one or more highly-directional speakers 110 and one or more sensors 120. In some embodiments, the sensor 120 includes two or more visual sensors 350 that are configured to capture stereoscopic images of objects and/or users within the listening environment 102.

Processing unit 310 may include a central processing unit (CPU), digital signal processing unit (DSP), and so forth. In various embodiments, the processing unit 310 is configured to analyze data acquired by the sensor(s) 120 to determine locations, distances, orientations, etc. of objects and/or users within the listening environment 102. The locations, distances, orientations, etc. of objects and/or users may be stored in the database 334. The processing unit 310 is further configured to compute a vector from a location of a highly-directional speaker 110 to a surface of an object and/or vector from a surface of an object to a listening position 106 based on the locations, distances, orientations, etc. of objects and/or users within the listening environment 102. For example, and without limitation, the processing unit 310 may receive data from the sensor 120 and process the data to dynamically track the movements of a user within a listening environment 102. Then, based on changes to the location of the user, the processing unit 310 may compute one or more vectors that cause an audio event generated by a highly-directional speaker 110 to bounce off of a specific location 132 within the listening environment 102. The processing unit 310 then determines, based on the one or more vectors, an orientation in which the driver(s) 210 of the highly-directional speaker 110 should be positioned such that the user perceives the audio event as originating from the desired location in the sound space 104 generated by the audio system 100. Accordingly, the processing unit 310 may communicate with and/or control the pan-tilt assembly 220.

I/O devices 320 may include input devices, output devices, and devices capable of both receiving input and providing output. For example, and without limitation, I/O devices 320 may include wired and/or wireless communication devices that send data to and/or receive data from the sensor(s) 120, the highly-directional speakers 110, and/or various types of audio-video devices (e.g., amplifiers, audio-video receivers, DSPs, and the like) to which the audio system 100 may be coupled. Further, in some embodiments, the I/O devices 320 include one or more wired or wireless communication devices that receive audio streams (e.g., via a network, such as a local area network and/or the Internet) that are to be reproduced by the highly-directional speakers 110.

Memory unit 330 may include a memory module or a collection of memory modules. Software application 332 within memory unit 330 may be executed by processing unit 310 to implement the overall functionality of the computing device 300, and, thus, to coordinate the operation of the audio system 100 as a whole. The database 334 may store digital signal processing algorithms, audio streams, object recognition data, location data, orientation data, and the like.

Computing device 300 as a whole may be a microprocessor, an application-specific integrated circuit (ASIC), a system-on-a-chip (SoC), a mobile computing device such as a tablet computer or cell phone, a media player, and so forth. In other embodiments, the computing device 300 may be coupled to, but separate from the audio system 100. In such embodiments, the audio system 100 may include a separate processor that receives data (e.g., audio streams) from and transmits data (e.g., sensor data) to the computing device 300, which may be included in a consumer electronic device, such as a vehicle head unit, navigation system, smartphone, portable media player, personal computer, and the like. For example, and without limitation, the computing device 300 may communicate with an external device that provides additional processing power. However, the embodiments disclosed herein contemplate any technically feasible system configured to implement the functionality of the audio system 100.

In various embodiments, some or all of the components of the audio system 100 and/or computing device 300 are included in a mobile device, such as a smartphone, tablet, watch, mobile computer, and the like. In such embodiments, the pan-tilt assembly 220 may be coupled to a body of the mobile device and may dynamically track, via sensor(s) 120, the ears of the user and/or the objects within the listening environment 102 off of which audio events may be reflected. For example, user and object tracking could be performed by dynamically generating a three-dimensional map of the listening environment 102 and/or by using techniques such as simultaneous localization and tracking (SLAM). Additionally, miniaturized, robotically actuated pan-tilt assemblies 220 coupled to the highly-directional speakers 110 may be attached to the mobile device, enabling a user to walk within a listening environment 102 while simultaneously experiencing three-dimensional surround sound. In such embodiments, the sensor(s) 120 may continuously track the listening environment 102 for suitable objects in proximity to the user off of which sound waves 112 can be bounced, such that audio events are perceived as coming from all around the user. In still other embodiments, some or all of the components of the audio system 100 and/or computing device 300 are included in an automotive environment. For example, and without limitation, in an automotive listening environment 102, the highly-directional speakers 110 may be mounted to pan-tilt assemblies 220 that are coupled to a headrest, dashboard, pillars, door panels, center console, and the like.

Figure 4A:
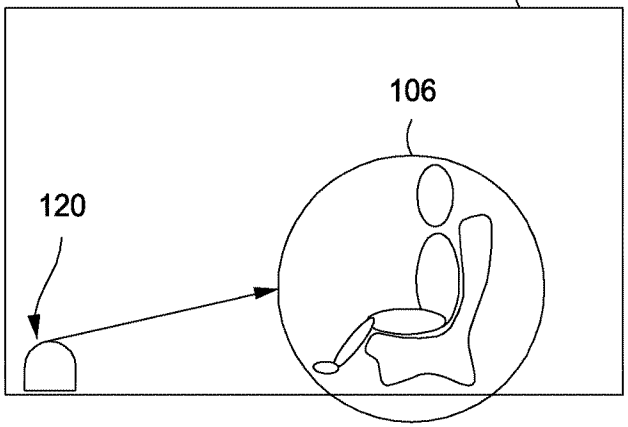
FIGS. 4A-4E illustrate a user within the listening environment of FIG. 1 interacting with the audio system of FIG. 1, according to various embodiments.
Figure 4B:
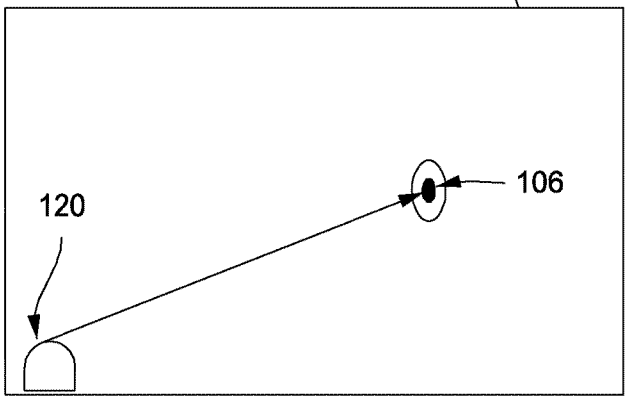

FIGS. 4A-4E illustrate a user interacting with the audio system 100 of FIG. 1 within a listening environment 102, according to various embodiments. As described herein, in various embodiments, the sensor 120 may be implemented to track the location of a listening position 106. For example, and without limitation, as shown in FIG. 4A, the sensor 120 may be configured to determine the listening position 106 based on the approximate location of a user. Such embodiments are useful when a high-precision sensor 120 is not practical and/or when audio events do not need to be generated at precise locations within the sound space 104. Alternatively, the sensor 120 may be configured to determine the listening position 106 based on the location(s) of one or more ears of the user, as shown in FIG. 4B. Such embodiments may be particularly useful when the precision with which audio events are generated at certain locations within the sound space 104 is important, such as when a user is listening to a detailed movie soundtrack and/or interacting with a virtual environment, such as via a virtual reality headset.

Figure 4C:
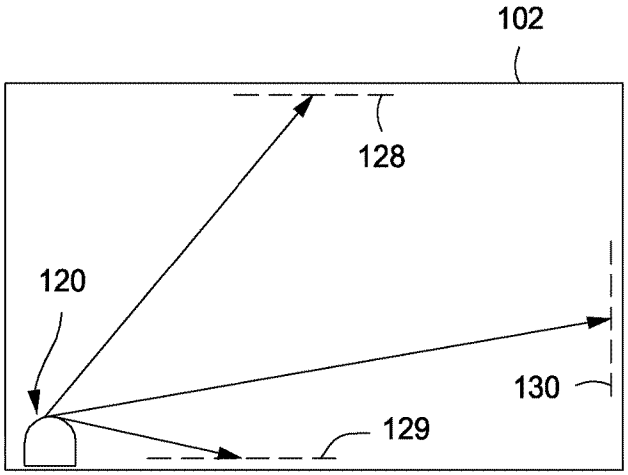
Figure 4D:
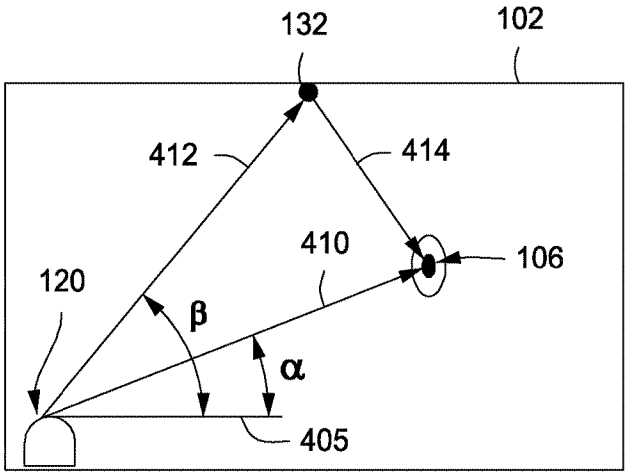

Once the listening position 106 has been determined via the sensor 120, the sensor 120 may further determine the location and orientation of one or more walls 130, ceilings 128, floors 129, etc. included in the listening environment 102, as shown in FIG. 4C. Then, as shown in FIG. 4D, the audio system 100 computes (e.g., via computing device 300) one or more vectors that enable an audio event to be transmitted by a highly-directional speaker 110 (e.g., via sound waves 112) and reflected off of a surface of the listening environment 102 and towards a user. Specifically, as shown, and without limitation, the computing device 300 may compute a first vector 410, having a first angle a relative to a horizontal reference plane 405, from the highly-directional speaker 110 to a listening position 106 (e.g., the position of a user, the position of an ear of the user, the position of the head of a user, the location of a primary seating position, etc.). The computing device 300 further computes, based on the first vector 410, a second vector 412, having a second angle 0 relative to the horizontal reference plane 405, from the highly-directional speaker 110 to a location 132 on a surface of an object in the listening environment 102 (e.g., a ceiling 128). The computing device 300 may further compute, based on the second vector 412 and the location 132 and/or orientation of the surface of the object, a third vector 414 that corresponds to a sound reflection from the location 132 to the listening position 106.

Figure 4E:
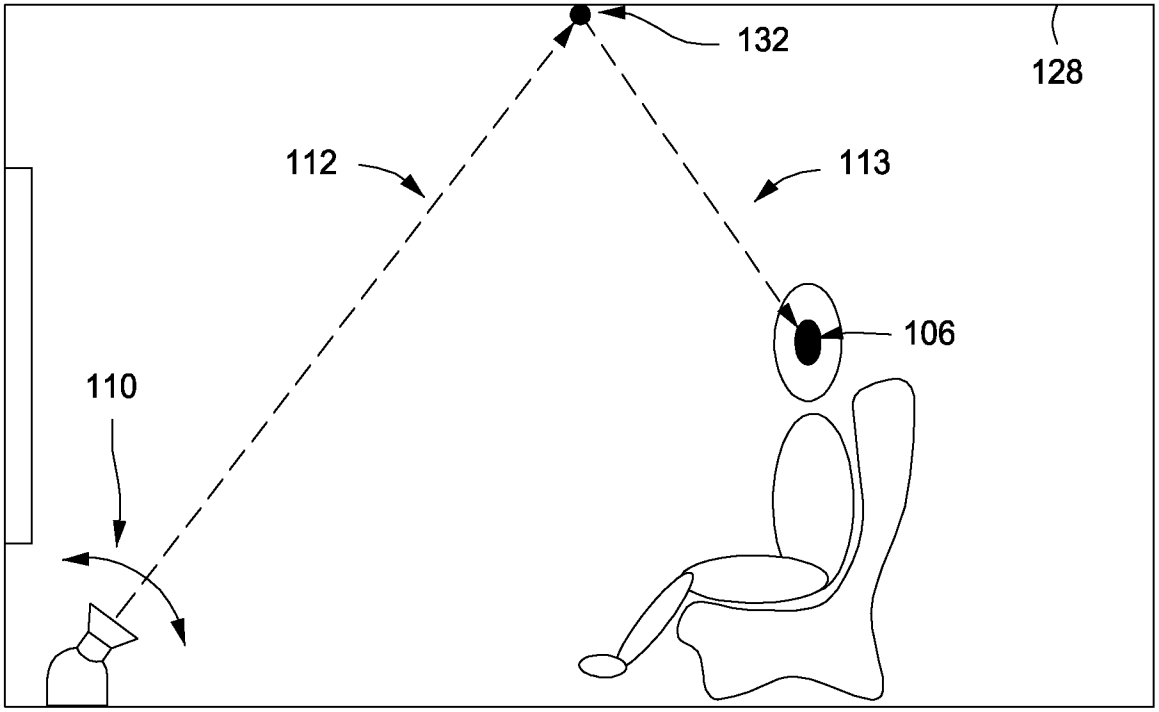

One embodiment of the technique described in conjunction with FIGS. 4A-4D is shown in FIG. 4E. Specifically, FIG. 4E illustrates the generation of an audio event, such as a helicopter sound intended to be located in an upper region of the sound space 104 (e.g., above the user), being generated by the audio system 100. As shown, the audio event is being reproduced by the highly-directional 110 speaker as sound waves 112, which are transmitted (e.g., via an ultrasound carrier wave) towards location 132 on the ceiling 128 of the listening environment 102. Upon striking the location 132 on the ceiling 128, the carrier waves drop off, and the reflected sound waves 113 propagate towards the listening position 106. Accordingly, the user perceives the audio event as originating from above the listening position 106, in an upper region of the sound space 104.

Figure 5:
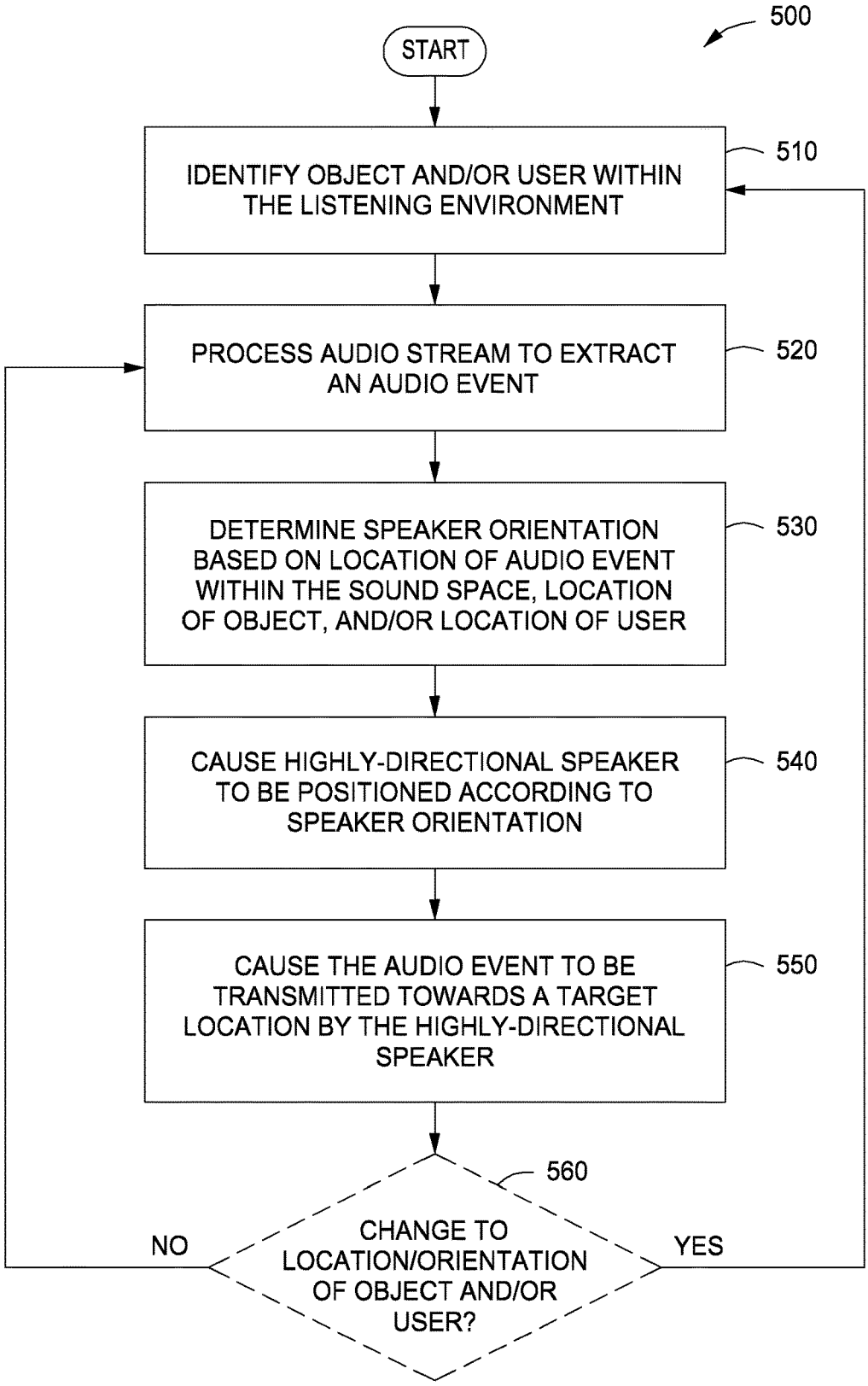
FIG. 5 is a flow diagram of method steps for generating audio events within a listening environment, according to various embodiments.

FIG. 5 is a flow diagram of method steps for generating audio events within a listening environment, according to various embodiments. Although the method steps are described in conjunction with the systems of FIGS. 1-4E, persons skilled in the art will understand that any system configured to perform the method steps, in any order, falls within the scope of the present invention.

As shown, a method 500 begins at step 510, where an application 332 executing on the processing unit 310 acquires data from the sensor 120 to identify the location(s) and/or orientation(s) of objects and/or listening positions 106 (e.g., the location of one or more users) within the listening environment 102. As described above, identification of objects within the listening environment 102 may include scene analysis or any other type of sensing technique.

At step 520, the application 332 processes an audio stream in order to extract an audio event included in the audio stream. In some embodiments, the audio stream includes a multi-channel audio soundtrack, such as a movie soundtrack or music soundtrack. Accordingly, the audio stream may contain information that indicates the location at which the audio event should be generated within the sound space 104 generated by the audio system 100. For example, and without limitation, the audio stream may indicate the audio channel(s) to which the audio event is assigned (e.g., one or more channels included in a 6-channel, 8-channel, etc. audio stream, such as a Dolby® Digital or DTS® audio stream). Additionally, the application 332 may process the audio stream to determine the channel(s) in which the audio event is audible. In such embodiments, the application 332 determines, based on the channel(s) to/in which the audio event is assigned/audible, where in the sound space 104 the audio event should be generated relative to the listening position 106. In some embodiments, the audio stream may indicate the location of the audio event within a coordinate system, such as a two-dimensional coordinate system or a three-dimensional coordinate system. For example, and without limitation, the audio stream may include information (e.g., metadata) that indicates the three-dimensional placement of the audio event within the sound space 104. Such three-dimensional information may be provided via an audio codec, such as the MPEG-H codec (e.g., MPEG-H Part 3) or a similar object-oriented audio codec that is decoded by the application 332 and/or dedicated hardware. In general, the audio system 100 may implement audio streams received from a home theater system (e.g., a television or set-top box), a personal device (e.g., a smartphone, tablet, watch, or mobile computer), or any other type of device that transmits audio data via a wired or wireless (e.g., 802.11x, Bluetooth®, etc.) connection.

Next, at step 530, the application 332 determines a speaker orientation based on the location of the audio event within the sound space 104, the location/orientation of an object off of which the audio event is to be reflected, and/or the listening position 106. As described herein, in some embodiments, the speaker orientation may be determined by computing one or more vectors based on the location of the highly-directional speaker 110, the location of the object (e.g., a ceiling 128), and the listening position 106. At step 540, the application 332 causes the highly-directional speaker 110 to be positioned according to the speaker orientation. In some embodiments, the application 332 preprocesses the audio stream to extract the location of the audio event a predetermined period of time (e.g., approximately one to three seconds) prior to the time at which the audio event is to be reproduced by the highly-directional speaker 110. Preprocessing the audio stream provides the pan-tilt assembly 220 with sufficient time to reposition the highly-directional speaker 110 according to the speaker orientation.

At step 550, while the highly-directional speaker 110 is positioned according to the speaker orientation, the application 332 causes the audio event to be transmitted by the highly-directional speaker 110 towards a target location 132, causing the audio event to be generated at the specified location in the sound space 104. Then, at step 560, the application 332 optionally determines whether the location and/or orientation of the object and/or user have changed. If the location and/or orientation of the object and/or user has changed, then the method 500 returns to step 510, where the application 332 again identifies one or more objects and/or users within the listening environment 102. If the location and/or orientation of the object and/or user have not changed, then the method 500 returns to step 520, where the application 332 continues to process the audio stream by extracting an additional audio event.

In sum, a sensor tracks a listening position (e.g., the position of a user) included in the listening environment. A highly-directional speaker then transmits sound waves towards the listening position and/or towards locations on one or more surfaces included in the listening environment. Sound waves are then reflected off of various surfaces included in the listening environment, towards a user, in order to generate audio events at specific locations within a sound space generated by the audio system.

At least one advantage of the techniques described herein is that a two-dimensional or three-dimensional surround sound experience may be generated using fewer speakers and without requiring speakers to be obtrusively positioned at multiple locations within a listening environment. Additionally, by tracking the position(s) of users and/or objects within a listening environment, a different sound experience may be provided to each user without requiring the user to wear a head-mounted device and without significantly affecting other users within or proximate to the listening environment. Accordingly, audio events may be more effectively generated within various types of listening environments.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of highly-directional speakers, sensors, and listening environments, persons skilled in the art will appreciate that the systems and techniques described herein are applicable to other types of highly-directional speakers, sensors, and listening environments. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A non-transitory computer-readable storage medium including instructions that, when executed by a processor, cause the processor to generate an audio event within a listening environment, by performing the steps of:

determining, based on sensor data associated with the listening environment, a location of a surface of an object relative to a speaker and a listening position included in the listening environment;

determining a speaker orientation based on (i) the location of the surface of the object relative to the speaker and the listening position and (ii) a location of the audio event within a sound space being generated within the listening environment;

causing the speaker to be positioned according to the speaker orientation; and while the speaker is positioned according to the speaker orientation, causing the audio event to be transmitted by the speaker.

2. The non-transitory computer-readable storage medium of claim 1, wherein the surface of the object included in the listening environment corresponds to the location of the audio event within the sound space.

3. The non-transitory computer-readable storage medium of claim 2, wherein determining the speaker orientation further comprises computing a vector from a location of the speaker to the surface of the object.

4. The non-transitory computer-readable storage medium of claim 3, wherein the object comprises at least one of a wall, a ceiling, and a furniture item included in the listening environment.

5. The non-transitory computer-readable storage medium of claim 1, wherein determining the speaker orientation comprises:

determining, based on the sensor data associated with the listening environment, an orientation of the surface of the object included in the listening environment;

determining a target location on the surface of the object based on the orientation of the surface of the object, a location of the speaker, and a listening position within the listening environment; and computing a vector from the location of the speaker to the target location on the surface of the object.

6. The non-transitory computer-readable storage medium of claim 1, further comprising processing an audio stream to extract the location of the audio event within the sound space, wherein the location of the audio event is specified within a three-dimensional coordinate system.

7. The non-transitory computer-readable storage medium of claim 1, further comprising preprocessing an audio stream to extract the location of the audio event a predetermined period of time prior to causing the audio event to be transmitted by the speaker, and causing the speaker to be positioned according to the speaker orientation during the predetermined period of time.

8. The non-transitory computer-readable storage medium of claim 1, further comprising:

determining a second speaker orientation based on a location of a second audio event within the sound space being generated within the listening environment;

causing the speaker to be repositioned according to the second speaker orientation; and while the speaker is positioned according to the second speaker orientation, causing the second audio event to be transmitted by the speaker.

9. The non-transitory computer-readable storage medium of claim 8, wherein determining the second speaker orientation comprises:

determining, based on the sensor data associated with the listening environment, an orientation of the surface of the second object;

determining a target location on the surface of the second object based on the orientation the surface of the second object, a location of the speaker, and a listening position within the listening environment; and computing a vector from the location of the speaker to the target location on the surface of the second object.

10. A system for generating an audio event within a listening environment, the system comprising:

a memory; and a processor coupled to the memory and configured to:

determine, based on sensor data associated with the listening environment, a location of a surface of an object relative to a speaker and a listening position included in the listening environment;

determine a speaker orientation based on (i) the location of the surface of the object relative to the speaker and the listening position and (ii) a location of the audio event within a sound space being generated within the listening environment, wherein the location of the audio event is specified within a three-dimensional coordinate system;

cause the speaker to be positioned according to the speaker orientation; and while the speaker is positioned according to the speaker orientation, cause the audio event to be transmitted by the speaker.

11. The system of claim 10, wherein the processor is configured to determine the speaker orientation by computing a first vector from the speaker to the surface of the object included in the listening environment, and computing a second vector from the speaker to a listening position included in the listening environment.

12. The system of claim 11, wherein the processor is configured to further determine the speaker orientation by computing a third vector from the surface of the object to the listening position.

13. The system of claim 11, wherein the object comprises at least one of a wall, a ceiling, and a furniture item included in the listening environment.

14. The system of claim 11, wherein the processor is further configured to track a change to a listening position within the listening environment, and determine the speaker orientation by further computing at least one vector based on the listening position, a target location on the surface of the object, and a location of the speaker.

15. The system of claim 10, further comprising a speaker coupled to the processor, wherein the processor is configured to cause the audio event to be transmitted by the speaker by causing the speaker to generate an ultrasound carrier wave.

16. The system of claim 15, wherein the processor is configured to cause the audio event to be transmitted by the speaker by causing sound waves associated with the audio event to be transmitted towards the surface of the object and reflected towards a listening position included in the listening environment.

17. The system of claim 10, wherein the processor is further configured to:

determine a surface of a second object included in the listening environment that corresponds to a location of a second audio event within the sound space;

determine a second speaker orientation based on the surface of the second object;

cause the speaker to be repositioned according to the second speaker orientation; and while the speaker is positioned according to the second speaker orientation, cause the second audio event to be transmitted by the speaker.

18. The system of claim 17, wherein the first object comprises a wall included in the listening environment and the second object comprises a ceiling included in the listening environment.

19. A method for generating an audio event within a listening environment, the method comprising:

determining, based on sensor data associated with the listening environment, a location of a surface of an object relative to a speaker and a listening position included in the listening environment;

determining, via a processor, a speaker orientation based on the location of the surface of the object relative to the speaker and the listening position, a location of the speaker, the listening position included in the listening environment, and a location of the audio event within a sound space being generated within the listening environment;

causing the speaker to be positioned according to the speaker orientation; and while the speaker is positioned according to the speaker orientation, causing the audio event to be transmitted by the speaker to generate the audio event at the location within the sound space.

20. The method of claim 19, further comprising tracking a change to the listening position, wherein determining the speaker orientation comprises computing at least one vector based on the listening position, the location of the speaker, and a target location on the surface of the object included in the listening environment.

* * * * *